United States Patent [19]

Klemz

[11] 4,206,528

[45] Jun. 10, 1980

[54] DOCTOR BLADES AND PRESSURE PLATES

[75] Inventor: David B. Klemz, Cowden, near Edenbridge, England

[73] Assignee: Vickerys Limited, London, England

[21] Appl. No.: 550

[22] Filed: Jan. 2, 1979

[30] Foreign Application Priority Data

Jan. 4, 1978 [GB] United Kingdom ..... 221/78

[51] Int. Cl.[2] ..... D21G 3/00

[52] U.S. Cl. ..... 15/256.51; 100/174; 101/425; 162/281

[58] Field of Search ..... 15/256.51; 100/174; 162/281; 101/425; 118/652; 355/15

[56] References Cited

U.S. PATENT DOCUMENTS

| | | | |
|---|---|---|---|
| 1,803,927 | 5/1931 | Vedder | 15/256.51 |
| 1,907,623 | 5/1933 | Vickery | 15/256.51 |
| 3,559,229 | 2/1971 | De Noyer | 15/256.51 |
| 4,114,228 | 9/1978 | Brown | 15/256.51 |

*Primary Examiner*—Edward L. Roberts

*Attorney, Agent, or Firm*—Watson, Cole, Grindle & Watson

[57] ABSTRACT

A doctor for a papermaking machine comprising a blade holder carrying a doctor blade and a pressure plate bearing against the doctor blade, the pressure plate and/or the doctor blade being formed of a multiplicity of short contiguous sections, with or without links connecting the sections together.

3 Claims, 4 Drawing Figures

DOCTOR BLADES AND PRESSURE PLATES

Figure 1:
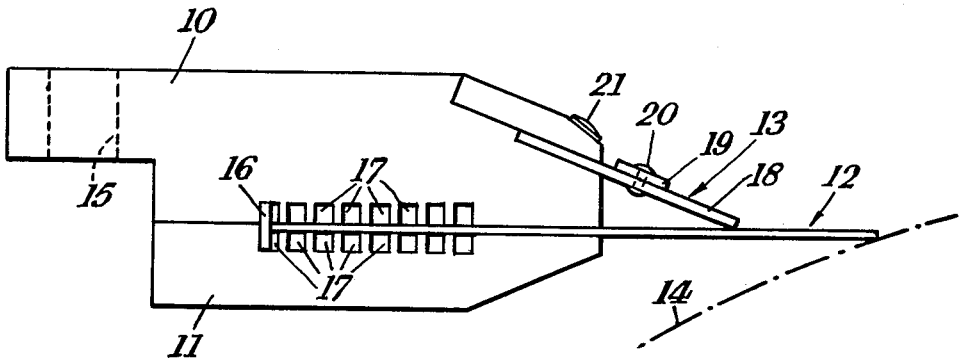

One of the problems that can arise with doctor blades used in papermaking machines is the generation of heat along the front edge of the blade that bears against the roll or cylinder to be doctored. This causes the hot front edge to expand more than the rear edge of the blade that is accommodated in the blade holder, with the result that the blade tends to distort and make uneven contact with the surface being doctored.

A similar problem can occur with pressure plates in a doctor, since heat is transferred from the doctor blade to the front edge of the pressure plate which bears against the doctor blade. This can cause distortion of the pressure plate and aggravate the problem of poor contact between the blade and the surface to be doctored.

With a view to overcoming this problem the invention provides a doctor for use in a papermaking machine comprising a blade holder, a doctor blade having its rear end accommodated in the blade holder and including a portion projecting forwardly from the holder, and a pressure plate having its rear end accommodated in the holder and its front end bearing against the projecting portion of the doctor blade, the doctor blade and/or the pressure plate consisting of a multiplicity of short contiguous sections.

Thus the doctor blade may be divided into short sections (say 100 mm in length) joined by links so that the front and rear edges of the blade are free to expand or contract with respect to each other at the same time keeping the front working edge of the blade free from distortion. Thus the sections may be joined by links, preferably disposed on the surface of the blade remote from the roll, and pivoted at their ends to rivets or other fasteners which secure them to the sections.

The pressure plate may also be divided into short sections joined by links as just described. This permits independent expansion and contraction of the edges of the pressure plate, keeps its front working edge free from distortion and ensures even contact between the pressure plate and the doctor blade.

It is possible to mix the sectional and conventional full length doctor blades and pressure plates, according to operating conditions on the paper machine, e.g. a conventional pressure plate can be used with a sectional doctor blade, a sectional pressure plate can be used with a traditional doctor blade, or a sectional pressure plate and a sectional doctor blade can be used together in the same doctor.

A further possibility is for the doctor blade to be manufactured in standard short sections a few inches long which are not joined together by links but are situated side by side in the blade holder. The sections of the blade can then be fed endwise into the blade holder, manually or by means of an injector, and blade changing will become much simpler than it is when a full length doctor blade is employed.

At present every doctor has to be engineered individually depending upon its particular position on the papermaking machine and the length of the blade holder and the blade will vary according to the length of the cylinder being doctored. With a sectional blade it is possible to use standard sections for all the doctors, it only being necessary in some cases to cut off a portion of one section to suit the assembled sections to the length of blade required at any particular site.

The pressure plate may also, if desired, consist of adjoining short sections without connecting links.

In preferred embodiments of the invention a linked sectional pressure plate is used in conjunction with a full length doctor blade and a full length pressure plate is used in conjunction with a sectional and unlinked doctor blade.

Figure 2:
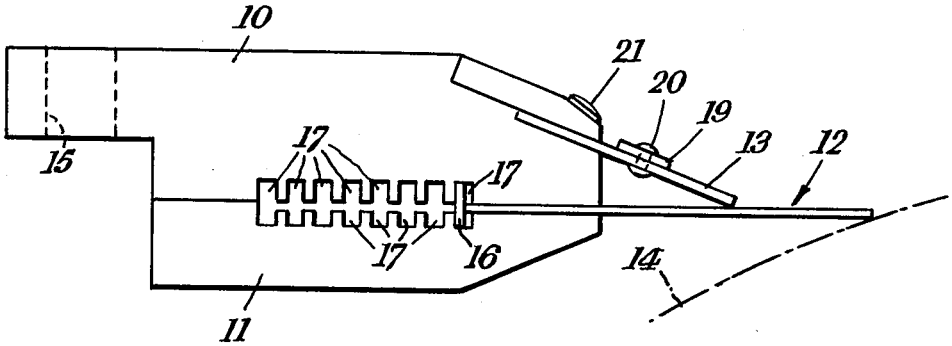
Figure 3:
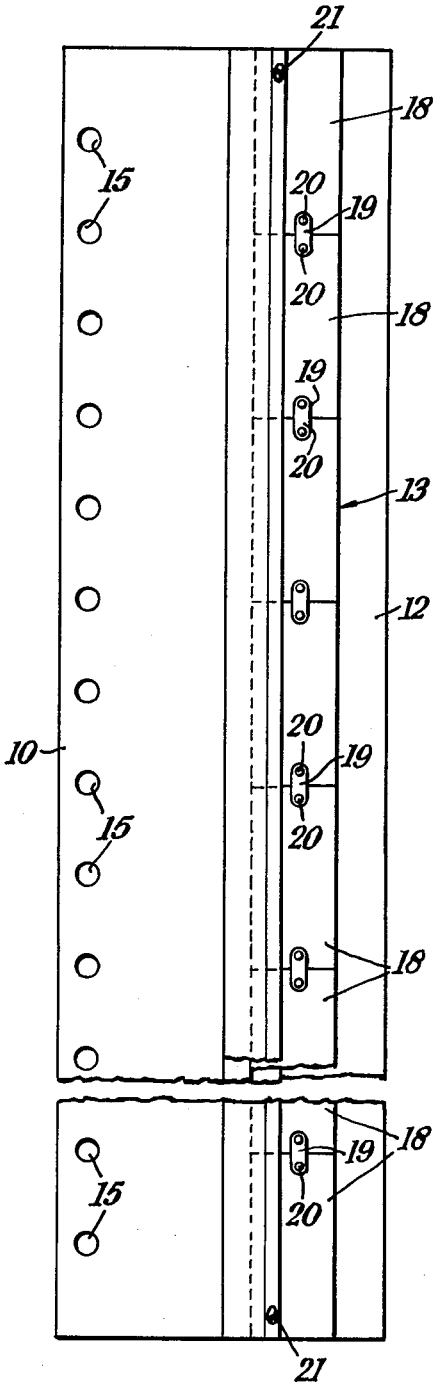
Figure 4:
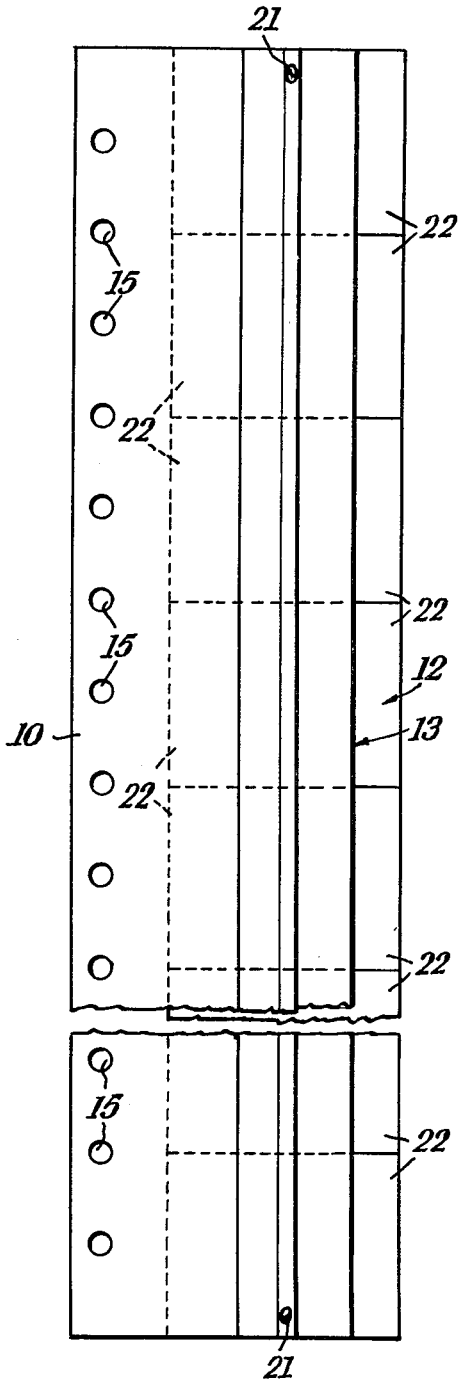

Two embodiments of the invention as applied to a creping doctor, are illustrated, by way of example, in the accompanying schematic drawings, in which:

FIG. 1 is an end view of the first embodiment showing the doctor when the blade is new, FIG. 2 is a similar view showing the doctor after the blade has become worn, FIG. 3 is a plan view, on a smaller scale, corresponding to FIG. 1, and FIG. 4 is a view similar to FIG. 3 of the second embodiment.

Like reference numerals denote like parts throughout the Figures.

The doctor shown in FIGS. 1–3 includes a blade holder, consisting of upper and lower parts 10, 11 suitably joined together by means not shown, a doctor blade 12 and a pressure plate 13. The rear portion of the doctor blade 12 is held between the parts 10, 11 of the holder and the front portion of the blade projects from the holder and contacts the cylinder 14 to be doctored. The rear portion of the pressure plate 13 is accommodated in the holder, end retaining screws 21 being provided, and the front edge of the pressure plate applies pressure to the projecting portion of the blade 12 at the side remote from the cylinder 14. The blade holder is mounted, by bolts or the like inserted through fixing holes 15, on a support (not shown) which is biased in the conventional way to press the front end of the blade 12 against the cylinder 14. The rear end of the blade bears against a backing plate 16.

The parts 10, 11 of the blade holder are formed with pairs of opposed slots 17 which accommodate the plate 16. When the blade 12 is new the plate 16 is disposed in the rearmost slots as shown in FIG. 1. As the blade 12 wears, the plate 16 is withdrawn endwise from the holder and replaced in the next pair of slots 17, this procedure being continued until finally the plate 16 is positioned in the front pair of slots 17 as shown in FIG. 2.

The blade 12 is of conventional construction and extends for the full length of the doctor. The pressure plate 13, however, is formed of short sections 18, joined by links 19 pivoted at their ends to rivets 20 extending through adjacent sections 18.

In use the doctor may be oscillated in relation to the cylinder 14 in the conventional manner.

In the other embodiment shown in FIG. 4, the blade holder is of the construction already described but the pressure plate 13 is conventional and extends for the full length of the holder. The doctor blade, however, consists of short contiguous unlinked sections 22.

What I claim as my invention and desire to secure by Letters Patent is:

1. A doctor for use in a papermaking machine, comprising a blade holder, a one-piece doctor blade having its rearward edge accommodated in the blade holder and including a portion projecting forwardly from the holder, said doctor blade extending for substantially the full length of the holder, and a pressure plate having its rearward end mounted on the holder and its forward edge bearing against the projecting portion of the doctor blade, said pressure plate comprising a plurality of closely adjacent, short, sections separated by gaps which extend for the full width of the pressure plate from the forward edge to the rearward end thereof, and pivoted linkages interconnecting said sections at locations between the forward edge and the rearward end of the pressure plate.

2. A doctor according to claim 1, which includes a backing plate for contacting the rear edge of the doctor blade, the backing plate being engageable with alternative slots in the blade holder to provide backing for the blade notwithstanding wear of the blade.

3. A doctor according to claim 1, wherein said linkages are constituted by links situated at the side of the pressure plate remote from the blade, said links extending between adjacent sections of the pressure plate and being pivotally mounted by fasteners at their opposite ends to said sections.

* * * * *